US010633159B2

(12) United States Patent
Jego

(10) Patent No.: US 10,633,159 B2
(45) Date of Patent: Apr. 28, 2020

(54) BLANK AND PACKAGING FOR PACK OF JARS WITH SPACING/BRACING PART AND METHOD FOR PACKAGING PACK OF JARS WITH SPACING/BRACING PART

(71) Applicant: SYNERLINK, Puiseux Pontoise (FR)

(72) Inventor: Fabien Jego, Asnieres sur Seine (FR)

(73) Assignee: SYNERLINK, Puiseux Pontoise (FR)

( * ) Notice: Subject to any disclaimer, the term of this patent is extended or adjusted under 35 U.S.C. 154(b) by 123 days.

(21) Appl. No.: 15/908,136

(22) Filed: Feb. 28, 2018

(65) Prior Publication Data

US 2018/0244450 A1 Aug. 30, 2018

(30) Foreign Application Priority Data

Feb. 28, 2017 (FR) ..... 17 51634

(51) Int. Cl.
*B65D 71/20* (2006.01)
*B65D 71/18* (2006.01)
(Continued)

(52) U.S. Cl.
CPC ..... *B65D 71/20* (2013.01); *B65D 71/18* (2013.01); *B65D 71/246* (2013.01); *B65D 71/26* (2013.01);
(Continued)

(58) Field of Classification Search
CPC ..... B65D 71/20; B65D 718/18; B65D 71/24; B65D 71/246; B65D 71/26;
(Continued)

(56) References Cited

U.S. PATENT DOCUMENTS 2,070,399 A * 2/1937 Goldring ..... B65D 71/0066 206/196
3,129,843 A * 4/1964 Weiss ..... B65D 71/20 206/140
(Continued)

FOREIGN PATENT DOCUMENTS

DE 1486283 A1 3/1969
DE 1293674 B 4/1969
(Continued)

OTHER PUBLICATIONS

French Search Report, dated Nov. 23, 2017, from corresponding FR application No. 1751634.

*Primary Examiner* — Rafael A Ortiz
(74) *Attorney, Agent, or Firm* — Young & Thompson

(57) ABSTRACT

A flat cardboard blank forms tubular envelope type packaging for a pack of jars. The blank extends substantially along a plane formed by a longitudinal axis and a transverse axis perpendicular to the longitudinal axis, where the plane further defines a packaging axis substantially perpendicular to the plane. The blank includes: tubular-blank panels including at least one top panel, two lateral panels, a base panel, a unit for securely attaching for closing the expanded blank on itself; cut lines, slot lines and score lines between the tubular-blank panels for folding the tubular-blank panels, expanding the blank and shaping the packaging of the pack; and a spacing/bracing part connected to the tubular-blank panels by cut lines, detachable from the tubular-blank panels when the packaging of the pack is shaped for being arranged and expanded into the bracing spacer and forming bracing walls of the braced jars on the lateral walls.

20 Claims, 5 Drawing Sheets

(51) Int. Cl.
*B65D 71/26* (2006.01)
*B65D 71/24* (2006.01)

(52) U.S. Cl.
CPC ..... *B65D 2571/0032* (2013.01); *B65D 2571/0066* (2013.01); *B65D 2571/00141* (2013.01); *B65D 2571/00277* (2013.01); *B65D 2571/00314* (2013.01); *B65D 2571/00339* (2013.01); *B65D 2571/00401* (2013.01); *B65D 2571/00716* (2013.01)

(58) Field of Classification Search
CPC ..... B65D 2571/00277; B65D 71/0066; B65D 71/00314
USPC ..... 206/193–200, 139, 147, 160, 427
See application file for complete search history.

(56) References Cited

U.S. PATENT DOCUMENTS 3,157,309 A * 11/1964 Chidsey, Jr. ..... B65D 71/20 206/155
3,163,322 A * 12/1964 Weiss ..... B65D 71/20 206/141
3,186,587 A 6/1965 Englander et al.
3,216,612 A 11/1965 Chidsey, Jr.
3,352,453 A * 11/1967 Weiss ..... B65D 71/26 206/140
3,361,254 A 1/1968 Weiss
3,372,800 A 3/1968 Arneson
3,498,449 A * 3/1970 Spery ..... B65D 71/16 206/148
3,680,765 A 8/1972 Harrelson
5,984,086 A * 11/1999 Foushee ..... B65D 71/16 206/147
2004/0226833 A1 * 11/2004 Daniel ..... B65D 71/46 206/139
2005/0155885 A1 * 7/2005 LeBras ..... B65D 71/16 206/427

FOREIGN PATENT DOCUMENTS

EP 0277079 A1 8/1988
EP 0461947 A1 12/1991
EP 0780319 A1 6/1997
FR 2648440 A1 12/1990
FR 2752225 A1 2/1998

* cited by examiner

BLANK AND PACKAGING FOR PACK OF JARS WITH SPACING/BRACING PART AND METHOD FOR PACKAGING PACK OF JARS WITH SPACING/BRACING PART

The invention relates to the field of packaging packs comprising several layers of jars grouped beside each other using a tubular envelope type cardboard packaging joining the layers of jars, made by expanding and closing a flat cardboard blank on itself.

More precisely, the subject matter of the invention is a flat cardboard blank intended to form a packaging for a pack including at least two layers of jars each comprising four jars, pairwise, side-by-side and facing, positively spaced and braced on the lateral walls thereof near their top walls thereof, a method for executing such a pack, and finally a packaging of such a pack.

A jar, such as the one from the pack in consideration, comprises a bottom wall, a lateral wall closed on itself, and a top lid. In a simple implementation, the jar has the shape of a conic frustum and comprises a transverse collar near the upper opening thereof, and the top lid is a flat covering securely joined to and on the collar. In other embodiments, the generatrix of the lateral wall is a line different than a straight line, having a more or less complex shape, and the directing shape can be other than a circle, for example a rectilinear square with rounded corners. Such a jar can remain upright by resting on the base-forming bottom wall. In other embodiments, the lateral wall is rounded for joining the bottom wall.

In an embodiment, a jar can be made of thermoformed plastic and it has a certain resistance allowing it to be self-carrying, but the jar can be made in other materials and by other means.

Such a jar is typically intended to contain a content which is homogeneous or not, and which has a more or less fluid overall state, without however excluding the presence of more or less solid pieces. Such a content is a dairy product or a dessert, for example; however this list is not limiting.

In an embodiment, the jar is intended to receive a quantity of such content for individual and unit use, for example of order 100 g and, in that case, it can have a height of order a few centimeters and fall laterally within a cylinder whose diameter is also of order of a few centimeters. In other embodiments, the jar, intended to receive a mini-quantity, is smaller or, in contrast, intended for a larger dose, is larger. The jar can also be a bottle, intended for a larger quantity.

In a possible elementary embodiment, the pack for example comprises a lower layer of four jars, pairwise, side-by-side and facing, in a square, and an upper layer of four jars arranged in the same way on the lower layer. In other embodiments, the pack comprises more than two layers of superposed jars. In other embodiments, one layer comprises more than four jars, for example arranged in three—or more—longitudinal rows and two transverse rows.

In a known way, in particular from document EP 0,461,947, a cardboard package, with tubular envelope shape, for a pack of jars comprising a single layer of four jars, is made from a flat cardboard blank of generally rectangular shape, bordered by two free edges in the longitudinal direction and two free edges in the transverse direction.

Such a blank comprises:

Arranged one after the other along the longitudinal direction, a first top panel, a first lateral panel, a first connecting panel, a base panel, a second connecting panel, a second lateral panel, and a second top panel, where the first top panel and the second top panel are arranged so as to be suited and intended to be arranged coplanar and securely joined with each other for closing the expanded blank on itself, forming a top wall of the packaging and shaping the packaging and the pack;

Transverse direction score lines, suited and intended for folding of the panels, expanding the blank and shaping the packaging, including two base score lines between the base panel and the two connecting panels, and two intermediate score lines, between the two connecting panels and the two lateral panels;

Cut lines;

A solid receiving part extending substantially over the base panel, suited and intended to receive jars by the bottom walls thereof.

In order that, in the finished pack, the jars cannot move unexpectedly or bump each other, or can only do so a little, it is intended that the cardboard blank also comprise a spacing/bracing part, suited and intended, once the packaging and the pack are shaped, to space and brace jars for bracing them each relative to the others near the bottom walls thereof.

In the embodiment described in document EP 0,461,947, this spacing/bracing part comes from the base panel, with score and cut out lines. It is intended to be expanded relative to the receiving part. In that way, borders are formed on the lateral walls of the jars near the bottom walls thereof. More precisely, the spacing/bracing part comprises a lower holding system composed of four opposite tabs, suited for being superposed and adhered so as to provide a separation of the vertical blanks of the expanded brace.

With such a disposition, placement of the bracing part requires going through a first step of expanding the brace and a second step of adhering the holding tabs pairwise. Further, the brace must be shaped before the jars are available on the base panel and the blank expanded. The result is a more complex expanding of the blank, because it requires a significant number of intermediate steps.

Starting from the embodiment of the flattened cardboard blank, known for the indicated destination, with which to form a final packaging of the tubular envelope type pack, where the pack includes at least one layer of jars comprising at least four braced jars, pairwise, side-by-side and facing, positively spaced and braced on the lateral walls thereof near their top wall thereof, where the blank comprises: two top panels, two lateral panels, a base panel, a means of securely attaching for closing the expanded blank on itself; cut line and score lines, and slot lines, able and intended for folding of the panels, for expanding the blank and shaping the packaging and the pack; and one spacing/bracing part for braced jars that are positively spaced and braced, coming from a top panel with cut lines, which can be expanded relative to the top panel, so as to form braces for the braced jars, and thus positively spaced and braced on the lateral walls thereof near their top wall thereof, the problem at the base of the invention is to provide a spacing/bracing part which does not require either an external pre-folding machine, or shaping before positioning the jars. This problem is posed in combination with the one of a spacing/bracing part whose embodiment involves a savings of cardboard.

A brief description of the invention follows.

According to a first aspect, the subject matter of the invention is a flat cardboard blank intended for forming tubular envelope type packaging for a pack of jars, where the pack includes at least one layer of jars, with at least four braced jars, [pairwise] side-by-side and facing, positively spaced by a bracing spacer, where the blank extends substantially along a plane formed by a longitudinal axis and a transverse axis perpendicular to the longitudinal axis, where the plane further defines a packaging axis substantially perpendicular to said plane, the blank comprising:

A plurality of tubular-blank panels comprising at least one top panel, two lateral panels, a base panel, a means of securely attaching for closing the expanded blank on itself;

Cut lines, slot lines and also score lines between the tubular-blank panels able and intended for folding the tubular-blank panels, expanding the blank and shaping the packaging of the pack;

Where the blank is characterized in that it further comprises:

A spacing/bracing part connected to the tubular-blank panels by cut lines so as to be able to be detached from the tubular-blank panels when the packaging of the pack is shaped for being arranged and expanded into the bracing spacer and forming bracing walls for the braced jars on the lateral walls thereof;

And in that the spacing/bracing part comprises a central portion and at least four fins extending from either side of the central portion of the spacing/bracing part by being joined to said central portion by score lines suited for allowing expanding the spacing/bracing part by folding the fins relative to the central portion, where said fins form said bracing walls for braced jars, and where said central portion forms a spacing portion for the braced jars.

According to another aspect, the spacing/bracing part is in close contact with the first top panel.

According to another aspect, the central portion and the four fins of the spacing/bracing part together are H-shaped and in which the spacing/bracing part is joined to a tubular-blank panel by three cut lines respectively joining the central portion of said tubular-blank panel and two of the four fins.

According to another aspect, the blank comprises:

Arranged one after the other in the direction of the longitudinal axis of the blank, a first spacing/bracing part, a first top panel, a first lateral panel, a base panel, a second lateral panel and a second top panel, with a means of securely attaching the two top panels with each other for closing the expanded blank on itself and form one top wall;

At least one base line between the base panel and the two lateral panels, at least one top line between the two top panels and the two adjacent lateral panels, and at least one cut portion between the spacing/bracing part and the first top panel, located on the peripheral edge of two fins adjacent to said first top panel and along the central portion included between said two fins.

According to another aspect, the bracing score lines between the central portion and the fins are curved, where the central portion is suited and intended to define a bottom of the spacing/bracing part when the packaging of the pack is shaped, where the bracing walls of the fins laterally delimit the spacing/bracing part, such that in a transverse section, the spacing/bracing part has an overall U shape.

According to another aspect, wherein a width of the central portion corresponds, with the packaging of the pack shaped, to a separation along the longitudinal axis between two adjacent braced jars.

According to another aspect, the blank comprises openings between the lateral panels and the adjoining top panels arranged on the top lines, where the openings are suited and intended to engage with the edge of the top lid of a braced jar.

According to another aspect, said openings are overall crescent-shaped, comprising a convex portion and a concave portion, where said convex portion is oriented towards the base panel, where the space delimited by the convex portion and the concave portion of the openings forms a receiving portion suited and intended for engaging with the lateral walls of the braced jars in the area of their top wall thereof, and where the concave portions are able and intended to engage with the edge of the top lid of a braced jar.

According to another aspect, the means of securely attaching is an adhesive strip, extending transversely on a top panel, suited and intended to come into contact with the first top panel when the packaging of the pack is shaped.

According to another aspect, at least one size of the base panel is substantially equal to a size of the second top panel.

According to another aspect, the lateral panels have, along the longitudinal axis, a narrowing of one transverse dimension followed by a widening of said transverse dimension.

According to another aspect, the cut portions comprise a plurality of slotted parts and scored parts, in particular directed diagonally relative to the longitudinal axis.

According to another aspect, the blank has an axis of symmetry corresponding to the longitudinal axis of the blank.

An objective of the invention is also a method for implementation of a packaging of a pack of jars, of tubular envelope type, where the pack includes at least one layer of jars comprising at least four braced jars, pairwise, side-by-side and facing, positively spaced by a bracing spacer, where each jar is of the type having a bottom wall, a lateral wall closed on itself so as to form a jar body, and a top lid, packaged on a pack made from a flat blank, expanded and closed on itself, wherein:

A flat cardboard blank is available;

At least four jars are available including at least four braced jars, intended to be part of the pack;

Four jars are arranged on the base panel of the blank, in a way that the jars are arranged pairwise, side-by-side and facing;

And then, the blank is expanded around the jars, by folding the lateral panels along both base lines and the first top panel along the adjacent top line;

And then, the spacing/bracing part is urged away from the first top panel and the jars, in such a way that:

The central portion of the spacing/bracing part is detached and separated away from the first top panel and is brought closer towards the base panel, along the packaging axis, in such a way that the bracing walls of the four fins are brought closer to the lateral walls of the braced jars, and in such a way as to be positioned adjacent to the lateral walls thereof in the area of their top wall thereof;

And then, the blank is closed on itself by folding the second top panel about the adjacent top line to be coplanar with the first top panel, and the two top panels are joined securely to each other so as to create a top wall and close the expended blank on itself.

According to an embodiment, to move the spacing/bracing part, the central portion is moved directly and in particular at least towards the bracing score lines and at least towards the three cut portions.

According to an embodiment, pressure directed towards the base panel is exerted on the central portion of the spacing/bracing part to detach the spacing/bracing part from the first top panel.

An objective of the invention is also a packaging for a pack of jars comprising a blank wherein:

- The base panel is arranged in a plane, where the base panel, the central portion and the top panel are substantially parallel and separated from each other along the packaging axis, and where the transverse portion is arranged between the base panel and the top wall;
- The spacing/bracing part is detached from the remainder of the packaging;
- The lateral panels are substantially perpendicular to the base panel;
- The fins, arranged symmetrically pairwise at the ends of the central portion, and the lateral panels are substantially parallel;
- The bracing walls, one per braced jar, corresponding to the walls of the fins, are in direct contact with the braced jars;
- The receiving portions, one per braced jar, corresponding to the spaces defined by the openings, are in close contact with the braced jars.

According to an embodiment, the fins form a right angle with the central portion.

An objective of the invention is a system comprising a pack of jars comprising at least one layer of jars of at least four jars comprising at least four braced jars, pairwise, side-by-side and facing, positively spaced by a bracing spacer, where the jars are of a type having a bottom wall, a lateral wall closed on itself so as to form a jar body, and an opening closed by a top lid, and a packaging wherein:

- The jars are received by the bottom walls thereof on the base panel;
- The top wall is applied on or adjacent to the top lid of the braced jars making up the pack;
- The bracing walls of the fins of the spacing/bracing part are placed adjacent to the lateral wall of the braced jars near their top walls thereof, in order to brace the braced jars near their top walls thereof;
- The central portion of the spacing/bracing part is placed adjacent to the lateral wall of the braced jars near their top walls thereof, in order to space the braced jars near their top walls thereof;

According to an embodiment, the braced jars are braced between on one side the bracing walls and on the other the receiving portions, and placed adjacent to the lateral wall of the braced jars, near their top wall thereof, in order to brace the braced jars near their top walls thereof, where the openings of the braced jars are adjacent to the concave portions of the openings.

According to an embodiment, the jars do or don't comprise a collar near the opening and are not connected to each other.

According to an embodiment, the jars have an opening narrower than the body of said jars.

According to an embodiment, the pack comprises a lower layer of lower jars and an upper layer of braced jars.

According to an embodiment, the upper and lower layers comprise four jars each and, at least two additional jars from each or both sides of each layer of jars, arranged in extension of the initial four jars of each layer.

According to an implementation, the jars are yogurt cups.

According to an implementation, the jars are bottles.

Now the figures of drawings are going to be described briefly.

FIG. 1 is an elevation view of a possible embodiment of the blank according to the invention, shown flat, intended for the implementation of a pack having two superimposed layers of jars, including one lower layer of four lower jars, pairwise and facing, and one upper layer of four braced jars, pairwise and facing, intended to be positively spaced and braced on the lateral walls thereof near their top walls thereof, according to the invention.

Figure 6:
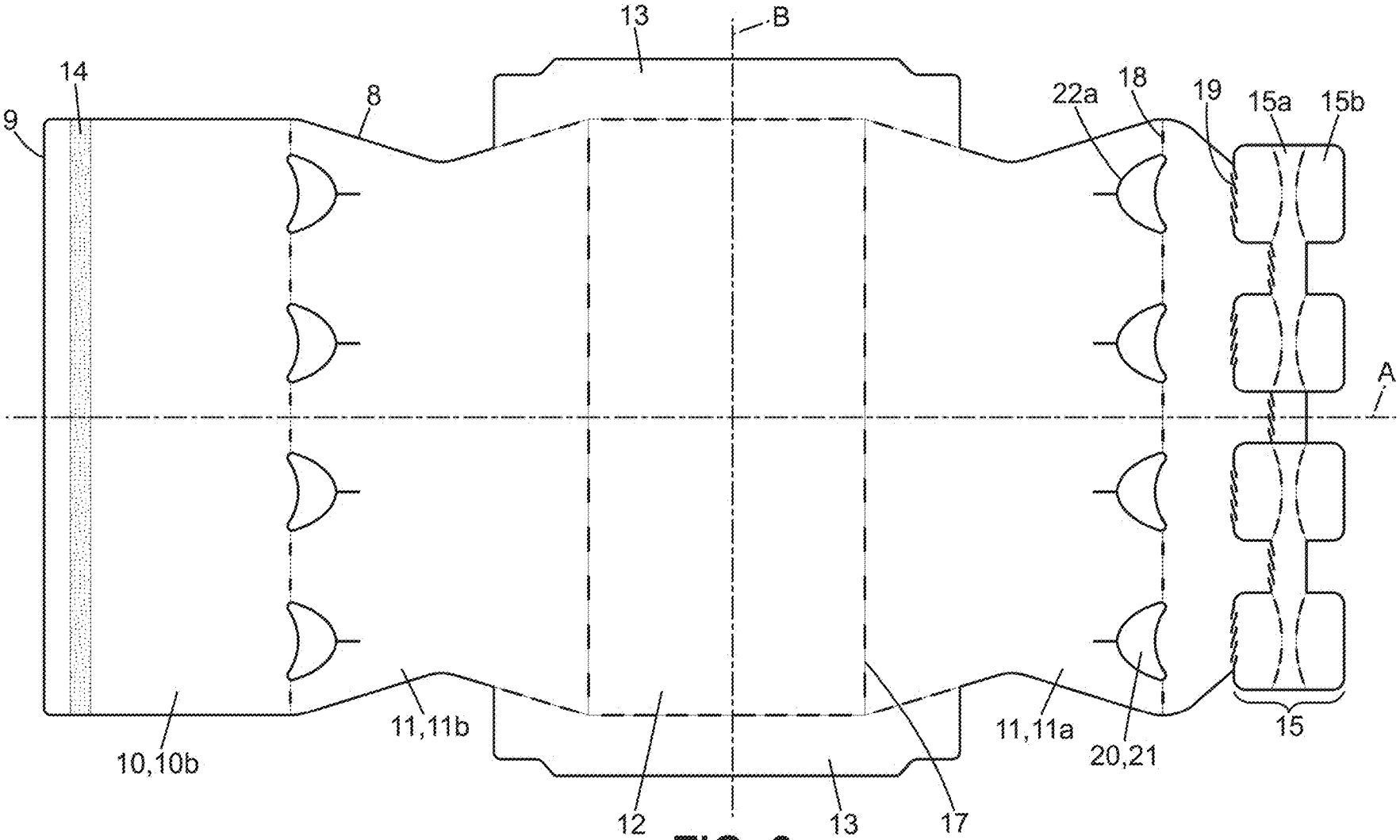

FIG. 6 is an elevation view of a possible embodiment of the blank according to another embodiment of the invention, shown flat, intended for the implementation of a pack having two superimposed layers of jars, including one lower layer of eight lower jars, pairwise and facing, and one upper layer of eight braced jars, pairwise and facing, intended to be positively spaced and braced on the lateral walls thereof near their top walls thereof, according to the invention.

A detailed description of several embodiments the invention combined with examples and referring to the drawings follows.

A flat cardboard blank 1 intended to form a packaging 5 for a pack 2 where the pack 2 also comprises jars 3 including at least four jars described as "braced jars 3*a*".

The packaging 5 is a tubular envelope type and is made by expanding the blank 1 and closing it on itself in order to match the jars 3 of the pack 2 which is thus held grouped.

By "tubular envelope", it must be understood that the packaging 5 has six total surfaces and has a general parallelepiped shape, comprising at least four adjacent surfaces closed on themselves and for example two facing open surfaces open in the examples from the figures.

The term "pack" must be understood as meaning a batch formed of several jars 3 presented grouped in layers—superposed in case of a plurality of layers—in longitudinal rows and transverse rows, in a packaging, such as in this case a tubular cardboard envelope, in order to form a unitary assembly intended to be stored, manipulated, moved, displayed for sale and sold as such.

The jars 3 which make up the pack 2 comprising at least four braced jars 3*a*. The qualification "braced jar 3*a*" serves to distinguish one such jar from another jar from the pack 2 specifically a jar from the lower layer 3*b*. In the description, the expression "positively spaced and braced jar 3*a*" applies to a braced jar 3*a* once it is actually positively spaced and braced, relative to the other braced jars 3*a* whereas the expression "braced jar 3*a*" applies to a jar 3*a* which is not yet positively spaced and braced.

The description with reference to FIGS. 1 to 4 relates to the specific embodiment of a pack 2 of jars 3 with two layers, including a lower layer 4*a* of four jars 3 called, implicitly, lower jars 3*b* and an upper layer 4*b* of four braced jars 3*a* superposed on the lower layer 4*a*, where the jars of each layer are pairwise, side-by-side and facing, arranged in a square and positively spaced. An objective of this specific case is an elementary blank 1, an elementary packaging 5 and such an elementary pack 2.

Figure 5:
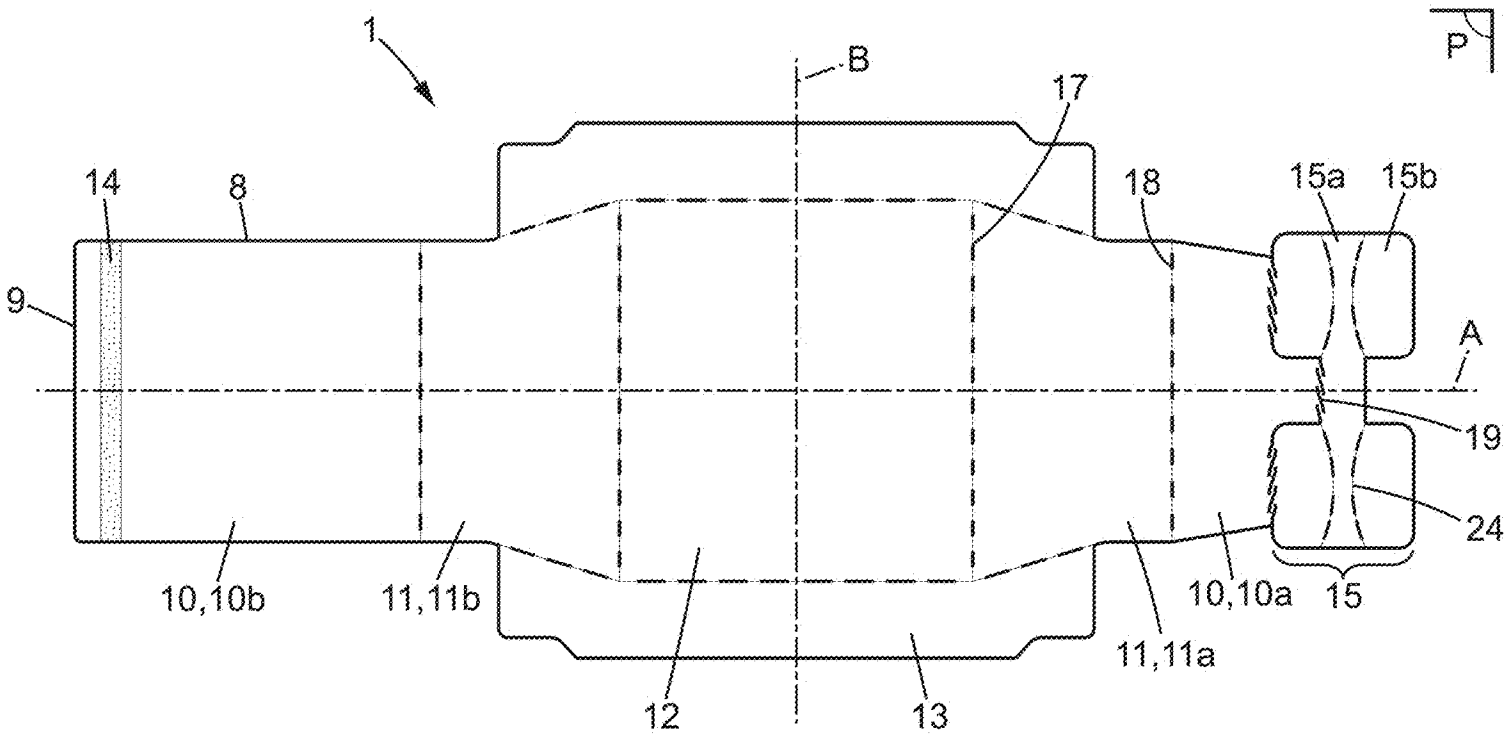
FIG. 5 is an elevation view of a possible embodiment of the blank according to another embodiment invention, shown flat, intended for the implementation of a pack having one layer of four braced jars, pairwise and facing, intended to be positively spaced and braced on the lateral walls thereof near their top walls thereof, according to the invention.

However, more generally, the objective of the invention is also any blank 1, any packaging 5 and any pack 2 made from or comprising or derived from such an elementary blank 1, such an elementary packaging 5 and such an elementary pack 2, or including the means of spacing/bracing thereof. Such embodiments are shown without limitation by FIG. 5 showing that a pack 2 can comprise a single layer of jars or other jars than the four lower jars 3*b* and the four braced jars 3*a*. In all conceivable embodiments falling within the scope of the invention, the pack 2 includes four braced jars 3*a* for the upper layer of jars which are positively spaced and braced, according to the invention.

"Cardboard" must be understood to be a material in a layer such as commonly used or suited for a blank having the indicated purpose. Such cardboard cannot be either too rigid or too flexible. It must be possible to fold it in the area of the score lines provided for that purpose.

"Jar" 3 must be understood to be a container such as was described in the brief description and whose characteristics do not need to be described again here; recall that such a jar 3, which has some mechanical resistance allowing it to be self-supporting, comprises a bottom wall 6*c*, a lateral wall closed on itself 6*a* to form a jar body with an opening opposite the bottom, and a top lid 7. The jars 3 are individualized. In the context of the invention, the jars 3 of a given pack 2 are for example similar and more specifically identical, and they are filled with some content, identical or not for the various jars 3, and closed. The jars 3 for example have an overall spherical shape, with a narrower opening than the body of the jar.

"Flat" in the expression "flat blank" must be understood to mean that the blank 1 is deployed so as to be at least substantially in one single plane P. Unless stated otherwise, the term "blank" 1, without other qualifications, must be understood as targeting the flat blank 1 in contrast to the expanded blank 1 which forms the packaging 5.

Now, refer to FIGS. 1 to 4 concerning the case of an elemental pack 2 having two layers of jars, including one lower layer 4*a* of four lower jars 3*b*, pairwise side-by-side and facing, arranged in a square, and one upper layer 4*b* of four braced jars 3*a*, pairwise, side-by-side and facing, arranged in a square, which in the pack 2 are in fact positively spaced and braced.

Relative to the blank 1, a longitudinal axis, or longitudinal direction, A and a transverse axis, or transverse direction, B mutually perpendicular can be defined in the plane P as can an axis C perpendicular or substantially perpendicular to the plane P, subsequently defining the packaging axis C or the packaging direction.

The blank 1 comprises for example, arranged one after the other in the direction of the longitudinal axis A, extending transversely, a spacing/bracing part 15, a first top panel 10*a*, a first lateral panel 11*a*, a base panel 12, a second lateral panel 11*b* and a second top panel 10*b*. The first top panel 10*a*, the first lateral panel 11*a*, the base panel 12, the second lateral panel 11*b* and the second top panel 10*b* are more generally called "tubular-blank panels" and together form the body 1*a* of the blank 1.

The body 1*a* of the blank 1 is for example limited by two edges 8 in the direction of the longitudinal axis A and two edges 9 in the direction of the transverse axis B. In the embodiment shown, the body 1*a* of the blank has an overall rectangular shape. The two edges 8 delimit the two edges of the two open surfaces of the packaging 5.

"Panel" must be understood to mean a layer-shaped flat part, of cardboard in this case, delimited by a border comprising score lines and/or cut lines.

The blank 1 can also comprise a means for securely attaching 14 the two top panels 10*a*, 10*b* to each other in order to close the expanded blank 1 on itself forming the top wall 10*c*. For example, the second top panel 10*b* is wide (along the direction of the longitudinal axis A) and intended to form the entire surface of the top panel 10*c* even though the first top panel 10*a* is narrow (along the direction of the longitudinal axis A), like a flap, and provided for example with adhesive for securely attaching 14 suited to come on the back of the top panel 10*a*. Such an embodiment does not exclude others, for example by means of securely attaching by engaging tabs and notches.

A top panel is designated generically by the numerical reference 10 and, similarly, a lateral panel by the reference 11.

The body 1*a* of the blank 1 also comprises cut lines and score and slot lines. These lines are suited and intended for the relative folding of the panels 10, 10*a*, 10*b*, 11, 11*a*, 11 *b* and 12 for expanding the blank 1 and shaping the packaging 5 and the pack 3. The score and slot lines in fact comprise scored sections interspersed with cut sections. More precisely, these lines can be "5/5" type, meaning that the scored and cut sections have a length of 5 mm.

The blank 1 comprises for example two base lines 17 between the base panel 12 and the two lateral panels 11, 11*a*, 11 *b*, two top lines 18 between the two lateral panels 11, 11*a*, 11 *b* and the two top panels 10, 10*a*, 10*b* and three cut portions 19 between the spacing/bracing part 15 and the first top panel 10*a*. The base lines 17 and the top lines 18 are for example score and slot lines.

The blank 1 is such that the two lateral panels 11*a* and 11*b* have for example the same size and that the second top panel 10*b* and the base panel 12 have the same size.

"Size" can for example include longitudinal dimensions, transverse dimensions, a perimeter or an area of the panels.

The blank 1 comprises, in the plane P, a longitudinal median axis, oriented along the longitudinal direction A, a transverse median axis oriented along the transverse direction B, with an intersection X. The blank 1 also comprises a normal axis C, perpendicular or substantially perpendicular to the plane P. This axis C is also called the packaging axis 5. The blank 1 can be symmetric or substantially symmetric relative to the longitudinal median axis A. It is symmetric or substantially symmetric relative to the transverse axis B, if the top panels 10*a* and 10*b* and the spacing/bracing part 15 are not considered. The intersection X is located substantially in the center of the base 12.

The spacing/bracing part for jars 15 (sometimes designated, implicitly, "spacing/bracing part 15") includes a central portion 15*a* extending along the longitudinal direction between opposite longitudinal ends and in the transverse direction so as to be substantially narrower along the longitudinal direction than along the transverse direction. The central portion 15*a* is framed by four fins 15*b* having a generally rectangular shape. The four fins 15*b* are disposed symmetrically on either side of the longitudinal ends of the central portion 15*a* in such a way that the spacing/bracing part 15 has an overall H shape with a central bar oriented along the transverse direction.

The three cut portions 19 are able and intended to detach the spacing/bracing part 15 from the body 1*a* of the blank 1 during expansion thereof relative to the first top panel 10*a*. The three cut portions 19 are for example slot lines. The cut portions 19 are designed so it is possible to burst them in a controlled manner by application of a preset force, in particular along the longitudinal direction. When the spacing/bracing part 15 of the blank is disposed vertically above the space between two rows of jars, the spacing/bracing part 15 of the blank can thus be detached from the blank by application of force along the packaging direction vertically above said space between two rows of jars which leads to a shaping of the spacing/bracing part 15 and thus a force along the longitudinal direction applied on the cut portion 19 as is described more below.

For this purpose, the cut portions 19 can comprise slotted parts and scored parts of various shapes. In this case, the slotted and scored parts are on diagonals, meaning inclined relative to the direction of the longitudinal axis A, so as to favor cutting cardboard fibers and guaranteeing a relatively easy separation. The spacing/bracing part 15 also comprises four bracing score lines 24, curved, between the fins 15*b* and the central portion 15*a*.

The cut portions 19 are for example located on the edge of the fins 15*b* adjacent to the first lower panel 10*a* and on the central portion 15*a* framed by said fins 15*b* in the transverse direction. The offset of the cut portions 19 located on the edge of the fins 15*b* from the one or more cut portions 19 located on the edge of the central portion 15*a* serves to avoid folding of the spacing/bracing part 15 during handling of the flat blank 1.

Because of the curved shape of the bracing score lines 24 of the spacing/bracing part 15, it is also possible to match the shape of the jars when the spacing/bracing part 15 is expanded as is now going to be described.

More precisely, when the spacing/bracing part 15 is expanded relative to the first top panel 10*a*, the central portion 15*a* then forms the bottom of the spacing/bracing part 15 and guarantees the spacing of the braced jars 3*a* and the fins 15*b* forming the bracing wall 16 on the braced jars 3*a* specifically for bracing on the lateral walls 6*a* thereof near the top walls 6*b* thereof.

The curvature of the bracing score lines 24 serves to follow the shape of the jars when the bracing walls 16 are in contact with the braced jars 3*a*. This also serves to prevent the tilting of the bottom 23 in order to guarantee the proper hold and separation of the braced jars 3*a*. In transverse section, and when it is expanded, the spacing/bracing part 15 thus has an overall U-shape, where the fins are perpendicular to the central part 15*a*.

The blank 1 can further comprise four openings 20 arranged along the scored and slotted top lines 18, pairwise facing, with for example a general crescent shape, and the convex part of which is turned towards the base panel 12. These openings 20 form receiving portions 21 suited and intended to engage with the lateral wall 6*a* of a braced jar 3*a* near their top wall 6*b* thereof.

More precisely, the concave portion 22*b* of the opening 20 is adjacent or in contact with the top lid 7 of the braced jars 3*a* whereas the convex portion 22*a* of the opening is adjacent or in contact with the lateral walls 6*a* of the braced jars 3*a*.

When the blank 1 is expanded, the braced jars 3*a* are braced between the bracing wall 16 on one side and the receiving portions 21 on the other side.

The blank 1 can also comprise a lower bracing system 13 for the lower jars 3*b*. Such a bracing system for example comprises posts arranged on the base panel, or even foldable tabs present on the sides of the base panel and playing the role of gussets.

As a purely non-limiting example, the overall longitudinal dimension of the blank 1 can be equal to 54 cm and the respective longitudinal dimensions of the spacing/bracing part 15, first base panel 10*a*, first lateral panel 11*a*, base panel 12, second lateral panel 11*b* and second top panel 10*b* can respectively be included between 4 and 5 cm, 2 and 3 cm, 12 and 13 cm, 11 and 12 cm, 12 and 13 cm, and 10 and 11 cm.

The transverse dimensions of the base panel 12 can be included between 12 and 13 cm, where this dimension is substantially near the largest transverse dimension of the other tubular-blank panels.

Finally, the central portion 15*a* can have dimensions included between 0.5 and 1 cm.

The blank 1 and the spacing/bracing part 15 described can be varied and adapted in particular according to the shape of the jars 3 or the number of jars 3 as described below.

Now referring to FIG. 5 which shows a blank 1 specifically suited and intended for a pack 2 having a single layer of four jars 3, meaning four braced jars 3*a*.

The four braced jars 3*a* in the single layer of jars are received by the base panel 12 and are spaced and braced on the lateral walls 6*a* thereof near their top walls 6*b* thereof with means of spacing/bracing conforming to what was previously described with reference to FIGS. 1 to 4.

In the non-limiting embodiment illustrated in FIG. 5 and unlike the embodiment from FIGS. 1 to 4, it is not expected that the blank 1 comprises openings cut for receiving the top walls of four jars 3*a* because in this configuration the braced jars 3*a* are held near the bottom wall 6*c* thereof by the lower bracing system 13.

Also, the longitudinal dimension of the lateral panels 11, 11*a*, 11 *b* between the base line 17 and the top line 18 is reduced, as is the degree of curvature of the longitudinal wall near the lateral panels 11, 11*a*, 11*b*. Because of the smaller degree of curvature, the transverse dimension of the top panels 10, 10*a*, 10*b* is also reduced.

Now refer to FIG. 6 which shows a blank 1 which is specifically suited and intended for a pack having two layers of eight superposed jars, where the eight jars of the upper layer are braced jars.

What was previously described, with reference to the embodiment from FIGS. 1 to 4, about the existence of two superposed layers of jars can be transposed to the embodiment of FIG. 6 about the existence per se of these two layers.

Additionally, compared to the embodiment from FIGS. 1 to 4, the blank 1 from FIG. 6 is such that, in the transverse direction, it comprises, towards one of its longitudinal edges thereof, an extension of the top panels 10, 10*a*, 10*b*, lateral panels 11, 11*a*, 11*b*, base panel 13 and of the spacing/bracing part 15.

The extension can be provided either towards one or towards the other or towards both of the longitudinal edges 8.

Such an extension of the base panel 12, whose dimension in the direction of the transverse axis B is adapted to the use, is for example intended for receiving at least four additional jars 3*c* arranged pairwise and facing. In that way, the jars 3 of the lower and upper layers are respectively arranged in four longitudinal rows and two transverse rows. An objective of the invention is also the case where a larger number of longitudinal rows is planned.

Additionally, the spacing/bracing part 15, extended transversely, comprises a number of fins 15*b* matched to the number of braced jars 3*a*. Thus, in this specific embodiment, the spacing/bracing part 15 comprises eight fins, arranged pairwise symmetrically about the central portion 15*a* in such a way that each bracing wall 16 is opposite a lateral wall 6*a* and a braced jar 3*a* when expanding the spacing/bracing part 15.

Finally, the number of openings is increased in the same way proportionally to the number of braced jars, such that when the blank 1 is shaped, the top lids 7 of the braced jars 3*a* are in contact with the concave portion 22*b* of the openings 20.

Figure 1:
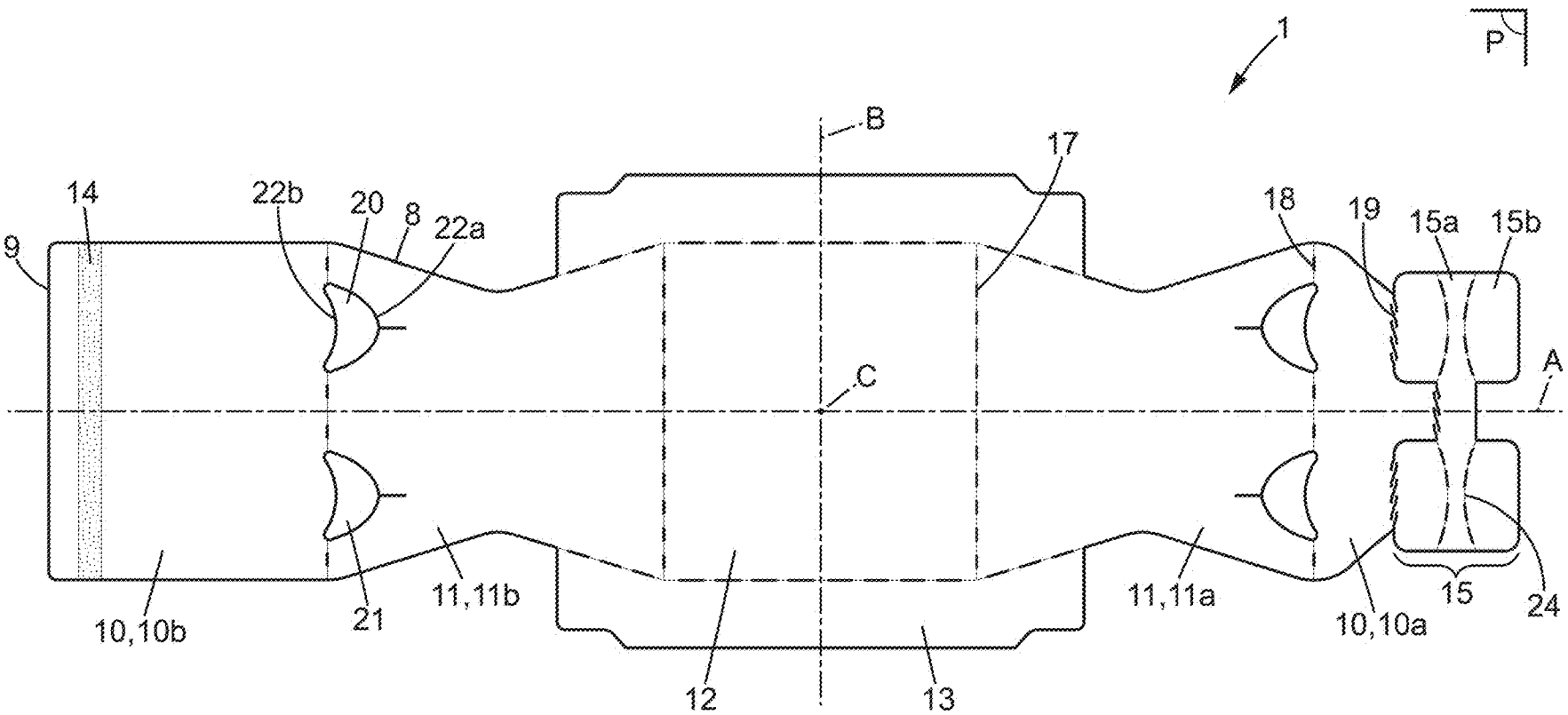
Figure 2:
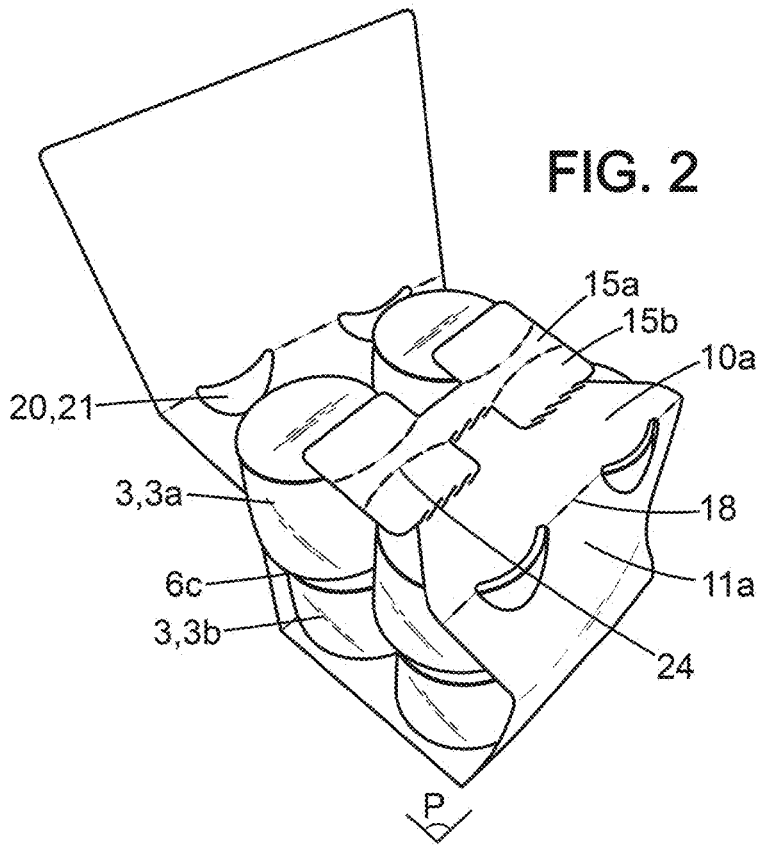
FIG. 2 is a perspective view in elevation for a pack with two layers of four jars made from a blank such as the one from FIG. 1 at an intermediate step of the pack implementation method conforming to the invention.
Figure 3:
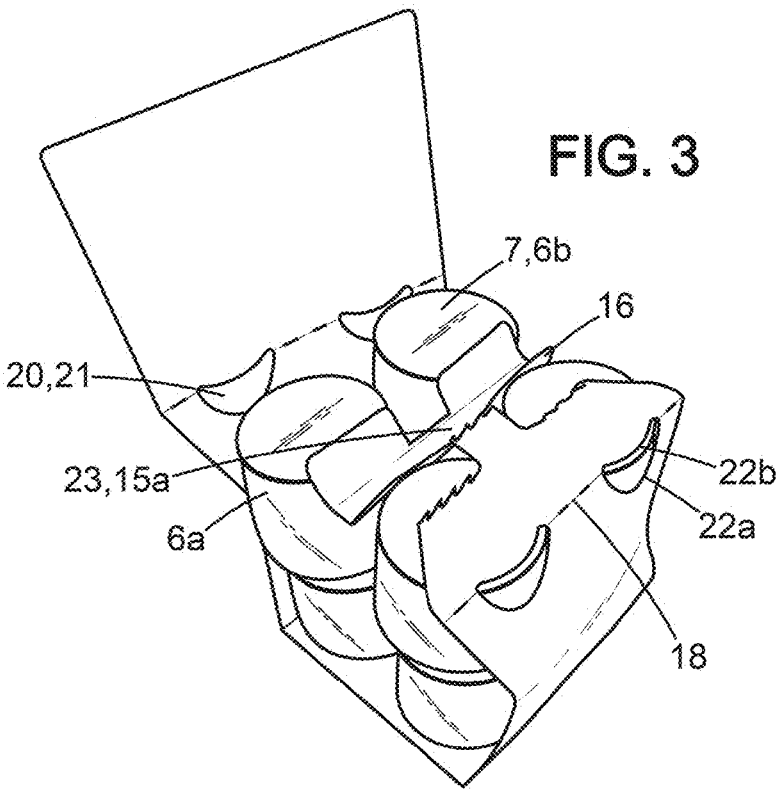
FIG. 3 is a perspective view in elevation for a pack with two layers of four jars made from a blank such as the one from FIG. 1 at an intermediate step of the pack implementation method conforming to the invention, more specifically showing expanding the spacing/bracing part.
Figure 4:
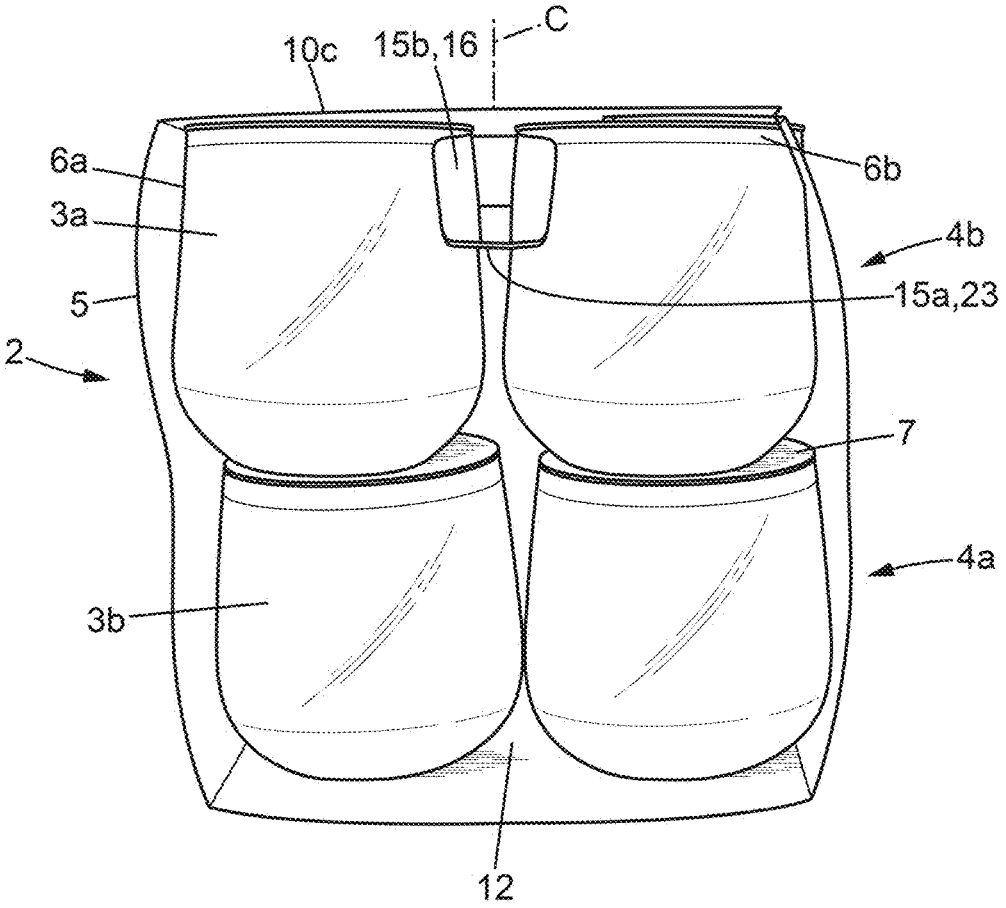
FIG. 4 is a perspective view in elevation for a pack comprising two layers of four jars made from a blank such as the one from FIG. 1.

The invention also relates to a method for execution of the packaging 5 of the pack 2 described more specifically with reference to the embodiment from FIGS. 2 to 4.

For this method, a flat cardboard blank 1, four braced jars 3*a* and three lower jars 3*b* intended to be part of the pack 3 are available.

Then, the four lower jars 3*b* are arranged in one lower layer of jars 4*a* on the base panel 12, while the blank 1 is disposed predominantly horizontally, such that the lower jars are for example arranged pairwise, side-by-side and facing in a square.

Then, the four braced jars 3*a* are disposed on the lower jars 3*b* with, for example, the bottom walls of the braced jars arranged resting on the top lids 7 of the lower jars 3*b*, such that the braced jars 3*a* are pairwise, side-by-side and facing in a square. There is therefore at least one bracing spacer between the braced jars 3*a*. The bracing spacer for example extends at least along the transverse direction and is suited for receiving the shaped spacing/bracing part 15 as is now going to be described.

Then, without changing the positioning of the jars, the blank 1 is expanded around the jars 3 of the pack 2 by folding lateral panels 11, 11*a*, 11 *b* around both base lines 17 and the first top panel 10*a* around a first adjacent top line 18.

The central portion 15*a* of the spacing/bracing part 15 is then disposed vertically, along the packaging direction, from said bracing spacer, between two rows of adjacent braced jars 3*a*.

Then, pressure is exerted on the central portion 15*a* of the spacing/bracing part 15, specifically along the packaging direction, so as to separate the central portion 15*a* away from the first top panel 10*a* and bring it closer towards the base panel 12 between two longitudinally adjacent rows of braced jars 3*a*, until detaching the spacing/bracing part 15 from the first top panel 10*a* near three cut portions 19. By exerting pressure, the fins 15*b* are folded near the four bracing score lines 24. Then, when the bracing walls 16 of the fins 15*b* are in direct contact with the transverse walls 6*a* of the braced jars 3*a* the pressure is stopped.

Then, the second top panel 10*b* is folded around the second scored and slotted top line 18, and both top panels 10*a* and 10*b* are disposed coplanar, for example one on the other, and the two top panels 10*a* and 10*b* are joined securely to each other, so as to close the expanded blank on itself, form the top wall 10*c* by using the means of securely attaching 14 and shape the packaging 5.

In this step, the top lids 7 of each braced jar 3*a* are engaged with the receiving portions 21 provided on the lateral panels 11, 11*a*, 11*b*.

A blank 1 suited and intended for a pack 2 with a single layer of jars can be arranged or a blank 1 suited and intended for several layers of jars can be arranged. A blank 1 suited and intended to receive four braced jars 3*a* can be arranged or else a blank 1 suited and intended for one or more layers comprising additional jars, for example eight jars, can be arranged. Depending on the situation, and by means of the implementation of the adapted blank 1, either four braced jars 3*a* are arranged in a single layer of jars, or else the lower layer of jars and then the upper layer of braced jars is arranged.

A packaging 5 is shown more specifically in FIG. 4 in the case of the embodiment from FIGS. 1 to 4.

In the shaped packaging 5, the base panel 12 is disposed in the plane P. The bottom 23 formed by the transverse central portion 15*b* and the top panel 10*c* are parallel to the base panel 12 and separated along the axis C. The two lateral panels 11, 11*a*, 11*b* extend perpendicularly or substantially perpendicularly to the plane of the base panel 12 up to the top wall 10*c* arranged above and plumb with the base panel 12.

In the shaped packaging 5, the spacing/bracing part 15 was expanded and is operational. The blocked jars 3*a* are held both by the bottom walls thereof resting on the top lids 7 of the lower jars 3*b*, and also by the bracing walls 16 of the fins 15*b* in contact with the portions of the lateral walls 6*a* of the braced jars 3*a* adjacent to the spacing/bracing part 15.

The detailed shape of the packaging 5 is suited to the shape of the jars 3. The description of the packaging which was just given does not exclude others, in the case of jars 3 of various shapes.

Further, and first, the packaging 5 depends on whether the blank 1 is according to the first embodiment (for a pack with two layers of jars) or according to the second embodiment (for a pack with only one layer of jars). Second, the packaging depends on whether the blank 1 is intended for a pack 2 whose layer (or layers) of jars comprises four jars 3 or else a pack 2 comprising eight jars 3.

In the case of a pack 2 having a single layer of jars, the shaped packaging is, overall, similar to that of a pack 2 with two superposed layers, except, first, that the dimension thereof along the axis C is smaller so as to be suited to the number of layers. Additionally, the packaging 5 might not comprise openings 20.

In the case of a pack 2 with two superposed layers of jars comprising for example eight jars 3, the shaped packaging is, overall, similar to that of the pack 2 with two superposed layers, except, first, that the transverse dimension thereof is larger considering the presence of additional jars.

The invention also covers a pack 2 comprising a lower layer of jars, pairwise, side-by-side and facing, and an upper layer of jars, pairwise, side-by-side and facing, positively spaced and braced, of types such as were described.

In such a pack, the jars 3 are received by the bottom walls 6*c* thereof on the base panel 12. The top wall 10*c* is applied on or adjacent to the top lid 7 of the jars from the pack 2 making up part of the upper layer, the bracing walls 16 are placed adjacent to the lateral walls 6*a* of the braced jars 3*a* near the top walls 6*b* thereof so as to provide the spacing and bracing of these jars 3*a* near the top walls 6*b* thereof.

Depending on the embodiments, the jars 3 do or do not comprise a collar near the opening. When the jars 3 comprise a collar, these collars can, when the jars from the upper layer of jars are involved, engage with the cut-out concave portions 22*b* of the openings 20.

The bracing walls 16 are suited for bracing the braced jars 3*a* on the lateral walls 6*a* thereof near their top walls 6*b* thereof.

"Bracing the braced jars 3*a* on the lateral walls 6*a* thereof" must be understood to mean that in the pack 2, the braced jars 3*a* are prevented, at least to some extent, from moving about—unexpectedly—relative to the packaging 5 or from bumping each other, because the lateral wall 6*a* of each braced jar 3*a* is adjacent to a given bracing wall 16 specific to each jar 3*a*.

Bracing the braced jars 3*a* on the lateral walls 6*a* thereof "near their top walls 6*b* thereof" must be understood to mean that the part of the lateral wall 6*a* of each braced jar 3*a* which, in the pack 2, is adjacent to the bracing wall 16 involved, is, for a substantial portion, separated from the upper wall 6*b* in the axial direction of this jar 3*a*—between the top wall 6*b* thereof and the top lid 7 thereof—with a relatively small separation compared to the separation between the bottom wall 6*c* and the top lid 7.

The term "adjacent" concerning the lateral wall 6*a* of a braced jar 3*a* and the corresponding bracing wall 16 must be understood to mean that, according to the circumstances—and in particular the play between the spacing/bracing part 15 and the lateral wall 6*a* of a braced jar 3*a*—the lateral wall 6*a* is in contact with the corresponding bracing wall 16, even with—if appropriate—some bearing force, so as to provide the bracing to stop the braced jar 3*a* in this position, or else that the lateral wall 6*a* is only in the immediate proximity of this bracing wall 16—for example a fraction of a millimeter or a few millimeters—such that the movement of the braced jar 3*a* is limited to the small separation between the lateral wall 6*a* and the corresponding bracing wall 16, and that at the end of possible movement of the braced jar 3*a*, the lateral wall 6*a* comes into contact with the bracing wall 16 so as to provide the blocking to stop the braced jar 3*a* in the end of movement position.

Since the bracing wall 16 are specific to bracing the braced jars 3*a*, as was just disclosed, they participate in that; in the pack 2, the braced jars 3*a* may not, or may only slightly, move unexpectedly or bump into each other.

The shape, disposition, and dimensions of the constituent parts the blank 1 and of the spacing/bracing part 15, and the disposition and dimensions of the jars 3 are matched such that in the shape to packaging 5, the lateral walls 6*a* of the braced jars 3*a* are adjacent to the bracing walls 16 as has been disclosed.

REFERENCES

| |
|---|
| Blank 1 |
| Pack 2 |
| Jar 3 |
| Braced jar 3a |
| Lower jar 3b |
| Additional jar 3c |
| Lower layer 4a |
| Upper layer 4b |
| Packaging 5 |
| Lateral wall 6a |
| Top wall 6b |
| Bottom wall 6c |
| Top lid 7 |
| Longitudinal edge 8 |
| Transverse edge 9 |
| Top panel 10 |
| First top panel 10a |
| Second top panel 10b |
| Top wall 10c |
| Lateral panel 11 |
| First lateral panel 11a |
| Second lateral panel 11b |
| Base panel 12 |
| Lower bracing system 13 |
| Means of securely attaching 14 |
| Spacing/bracing part 15 |
| Central portion 15a |

-continued

| |
|---|
| Fin 15b |
| Bracing wall 16 |
| Base line 17 |
| Top line 18 |
| Cut portion 19 |
| Opening 20 |
| Receiving portion 21 |
| Convex portion 22a |
| Concave portion 22b |
| Bottom 23 |
| Bracing score line 24 |

The invention claimed is:

1. A flat cardboard blank (1) intended for forming tubular envelope type packaging (5) for a pack (2) of jars (3), where the pack (2) includes at least one layer of jars (3), with at least four braced jars (3*a*), pairwise, side-by-side and facing, positively spaced by a bracing spacer, where the blank extends substantially along a plane (P) formed by a longitudinal axis (A) and a transverse axis (B) perpendicular to the longitudinal axis (A), where the plane (P) further defines a packaging axis (C) substantially perpendicular to said plane (P), the blank comprising:

a plurality of tubular-blank panels comprising at least one top panel (10, 10*a*, 10*b*), two lateral panels (11, 11*a*, 11*b*), a base panel (12), a means of securely attaching (14) for closing the expanded blank (1) on itself;

Cut lines, slot lines and also score lines between the tubular-blank panels able and intended for folding the tubular-blank panels, expanding the blank and shaping the packaging (5) of the pack (2);

wherein the blank further comprises:

a spacing/bracing part (15) connected to the tubular-blank panels by cut lines so as to be able to be detached from the tubular-blank panels when the packaging (5) of the pack (2) is shaped for being arranged and expanded into the bracing spacer and forming bracing walls on the lateral walls (6*a*) of the braced jars (3*a*);

and wherein the spacing/bracing part (15) comprises a central portion (15*a*) and at least four fins (15*b*) extending from either side of the central portion (15*a*) of the spacing/bracing part (15) by being joined to said central portion by score lines suited for allowing expanding the spacing/bracing part by folding the fins relative to the central portion, where said fins (15*b*) form said bracing walls (16) for braced jars (3*a*), and where said central portion (15*a*) forms a spacing portion for the braced jars (3*a*).

2. The cardboard blank (1) according to claim 1 wherein the spacing/bracing part (15) is in close contact with a first top panel (10, 10*a*).

3. The cardboard blank (1) according to claim 1, wherein the central portion (15*a*) and the four fins (15*b*) of the spacing/bracing part (15) together are H-shaped and in which the spacing/bracing part is joined to a tubular-blank panel by three cut lines respectively joining the central portion (15*a*) of said tubular-blank panel and two (15*b*) of the four fins.

4. The cardboard blank (1) according to claim 1, wherein the blank comprises:

arranged one after the other in the direction of the longitudinal axis (A) of the blank (1), the spacing/bracing part (15), a first top panel (10*a*), a first lateral panel (11*a*), the base panel (12), a second lateral panel (11*b*) and a second top panel (10*b*), with the means of securely attaching (14) the two top panels with each other for closing the expanded blank (1) on itself and form one top wall (10*c*);

at least one base line (17) between the base panel (12) and each lateral panel (11, 11*a*, 11*b*), at least one top line (18) between the two top panels (10, 10*a*, 10*b*) and the two adjacent lateral panels (11, 11*a*, 11*b*), and at least one cut portion (19) between the spacing/bracing part (15) and the first top panel (10*a*), located on the peripheral edge of two fins (15*b*) adjacent to said first top panel (10*a*) and along the central portion (15*a*) included between said two fins (15*b*).

5. The cardboard blank (1) according to claim 1, wherein:

bracing score lines (24) between the central portion (15*a*) and the fins (15*b*) are curved, where the central portion (15*a*) is suited and intended to define a bottom (23) of the spacing/bracing part when the packaging (5) of the pack (2) is shaped, where the bracing walls (16) of the fins (15*b*) laterally delimit the spacing/bracing part (15), such that in a transverse section, the spacing/bracing part (15) has an overall U shape.

6. The cardboard blank (1) according to claim 1, wherein a width of the central portion (15*a*) corresponds, with the packaging (5) of the pack (2) shaped, to a separation along the longitudinal axis (A) between two adjacent braced jars (3*a*).

7. The cardboard blank (1) according to claim 1, comprising openings (20) between the lateral panels (11, 11*a*, 11*b*) and the adjoining top panels (10, 10*a*, 10*b*) arranged on top lines (18), where the openings are suited and intended to engage with the edge of the top lid (7) of a braced jar (3*a*).

8. A method for implementation of a packaging (5) of a pack (2) of jars (3), of tubular envelope type, where the pack (2) includes at least one layer of jars (3) comprising at least four braced jars (3*a*), pairwise, side-by-side and facing, positively spaced by a bracing spacer, where each jar (3, 3*a*) is of the type having a bottom wall (6*c*), a lateral wall (6*a*) closed on itself so as to form a jar body (3), and a top lid (7), packaged in a pack (2) made from a flat blank (1), expanded and closed on itself, wherein:

a flat cardboard blank (1) according to claim 1 is available;

at least four jars (3) are available including at least four braced jars (3*a*), intended to be part of the pack (2);

four jars (3) are arranged on the base panel (12) of the blank (1), in a way that the jars (3) are arranged pairwise, side-by-side and facing;

and then, the blank (1) is expanded around the jars (3, 3*a*), by folding the lateral panels (11, 11*a*, 11*b*) along both base lines (17) and the first top panel (10*a*) along the adjacent top line (18);

and then, the spacing/bracing part (15) is urged away from the first top panel (10*a*) and the jars (3, 3*a*), in such a way that:

The central portion (15*a*) of the spacing/bracing part (15) is detached and separated away from the first top panel (10*a*) and is brought closer towards the base panel (12), along the packaging axis (C), in such a way that the bracing walls (16) of the four fins (15*b*) are brought closer to the lateral walls (6*a*) of the braced jars (3*a*), and in such a way as to be positioned adjacent to the lateral walls (6*a*) thereof in the area of the top wall (6*b*) thereof;

and then, the blank is closed on itself by folding the second top panel (10*b*) about the adjacent top line (18) to be coplanar with the first top panel (10*a*), and the two top panels (10, 10*a*, 10*b*) are joined securely to each other so as to create a top wall (10*c*) and close the expended blank (1) on itself.

9. The method according to claim 8 wherein pressure directed towards the base panel (12) is exerted on the central portion (15*a*) of the spacing/bracing part (15) to detach the spacing/bracing part (15) from the first top panel (10*a*).

10. Packaging (5) for a pack (2) of jars (3, 3*a*) made using a blank (1) according to claim 1 wherein:

the base panel (12) is arranged in a plane (P), where the base panel (12), the central portion (15*a*) and the top panel (10*c*) are substantially parallel and separated from each other along the packaging axis (C), and where the transverse portion (15*a*) is arranged between the base panel (12) and the top wall (10*c*);

the spacing/bracing part (15) is detached from the remainder of the packaging (5);

the lateral panels (11, 11*a*, 11*b*) are substantially perpendicular to the base panel (12);

the fins (15*b*), arranged symmetrically pairwise at the ends of the central portion (15*a*), and the lateral panels (11, 11*a*, 11*b*) are substantially parallel;

the bracing walls (16), one per braced jar (4*a*), corresponding to the walls of the fins (15*b*), are in direct contact with the braced jars (3*a*);

the receiving portions (21), one per braced jar (3*a*), corresponding to the spaces (20) defined by the openings, are in close contact with the braced jars (3*a*).

11. A system comprising a pack (2) of jars (3, 3*a*) including at least one layer of jars of at least four jars comprising at least four braced jars (3*a*), pairwise, side-by-side and facing, positively spaced by a bracing spacer, where the jars (3, 3*a*) are of a type having a bottom wall (6*c*), a lateral wall (6*a*) closed on itself so as to form a jar body (3, 3*a*), and an opening closed by a top lid (7), and a packaging according to claim 10, wherein:

the jars (3, 3*a*) are received by the bottom walls (6*c*) thereof on the base panel (12);

the top wall (10*c*) is applied on or adjacent to the top lid (7) of the braced jars (3*a*) making up the pack (2);

the bracing walls (16) of the fins (15*b*) of the spacing/bracing part (15) are placed adjacent to the lateral wall (6*a*) of the braced jars (3*a*) near their top walls (6*b*) thereof;

the central portion (15*a*) of the spacing/bracing part (15) is placed adjacent to the lateral wall (6*a*) of the braced jars (3*a*) near their top walls (6*b*) thereof, in order to space the braced jars (3*a*) near their top walls thereof (6*b*).

12. The system according to claim 11 wherein the braced jars (3*a*) are braced between the bracing walls (16) and the receiving portions (21) which are placed adjacent to the lateral wall (6*a*) of the braced jars (3*a*), near their top walls (6*b*) thereof, in order to brace the braced jars (3*a*) near their top walls (6*b*) thereof, where the openings of the braced jars (3*a*) are adjacent to the concave portions (22*b*) of the openings (20).

13. The system according to claim 11 comprising a lower layer (4*a*) of lower jars (3*b*) and an upper layer (4*b*) of braced jars (3*a*).

14. System according to claim 13 wherein the upper (4*a*) and lower (4*b*) layers comprise four jars (3, 3*a*, 3*b*) each and, at least two additional jars from each or both sides of each layer of jars (3, 3*a*, 3*b*), arranged in extension of the initial four jars (3, 3*a*, 3*b*) of each layer.

15. System according to claim 12 wherein the jars (3, 3*a*, 3*b*) are selected from a group consisting of:

yogurt cups; and bottles.

16. The cardboard blank (1) according to claim 2, wherein the central portion (15*a*) and the four fins (15*b*) of the spacing/bracing part (15) together are H-shaped and in which the spacing/bracing part is joined to a tubular-blank panel by three cut lines respectively joining the central portion (15*a*) of said tubular-blank panel and two (15*b*) of the four fins.

17. The cardboard blank (1) according to claim 2, wherein the blank comprises:

arranged one after the other in the direction of the longitudinal axis (A) of the blank (1), the spacing/bracing part (15), a first top panel (10*a*), a first lateral panel (11*a*), the base panel (12), a second lateral panel (11*b*) and a second top panel (10*b*), with the means of securely attaching (14) the two top panels with each other for closing the expanded blank (1) on itself and form one top wall (10*c*);

at least one base line (17) between the base panel (12) and each lateral panel (11, 11*a*, 11*b*), at least one top line (18) between the two top panels (10, 10*a*, 10*b*) and the two adjacent lateral panels (11, 11*a*, 11*b*), and at least one cut portion (19) between the spacing/bracing part (15) and the first top panel (10*a*), located on the peripheral edge of two fins (15*b*) adjacent to said first top panel (10*a*) and along the central portion (15*a*) included between said two fins (15*b*).

18. The cardboard blank (1) according to claim 3, wherein the blank comprises:

arranged one after the other in the direction of the longitudinal axis (A) of the blank (1), the spacing/bracing part (15), a first top panel (10*a*), a first lateral panel (11*a*), the base panel (12), a second lateral panel (11*b*) and a second top panel (10*b*), with the means of securely attaching (14) the two top panels with each other for closing the expanded blank (1) on itself and form one top wall (10*c*);

at least one base line (17) between the base panel (12) and each lateral panel (11, 11*a*, 11*b*), at least one top line (18) between the two top panels (10, 10*a*, 10*b*) and the two adjacent lateral panels (11, 11*a*, 11*b*), and at least one cut portion (19) between the spacing/bracing part (15) and the first top panel (10*a*), located on the peripheral edge of two fins (15*b*) adjacent to said first top panel (10*a*) and along the central portion (15*a*) included between said two fins (15*b*).

19. The cardboard blank (1) according to claim 2, wherein:

bracing score lines (24) between the central portion (15*a*) and the fins (15*b*) are curved, where the central portion (15*a*) is suited and intended to define a bottom (23) of the spacing/bracing part when the packaging (5) of the pack (2) is shaped, where the bracing walls (16) of the fins (15*b*) laterally delimit the spacing/bracing part (15), such that in a transverse section, the spacing/bracing part (15) has an overall U shape.

20. The cardboard blank (1) according to claim 3, wherein:

bracing score lines (24) between the central portion (15*a*) and the fins (15*b*) are curved, where the central portion (15*a*) is suited and intended to define a bottom (23) of the spacing/bracing part when the packaging (5) of the pack (2) is shaped, where the bracing walls (16) of the fins (15*b*) laterally delimit the spacing/bracing part (15), such that in a transverse section, the spacing/bracing part (15) has an overall U shape.

* * * * *